US010294087B2

(12) United States Patent
Hall et al.

(10) Patent No.: US 10,294,087 B2
(45) Date of Patent: May 21, 2019

(54) DIRECTIONAL WINCH-CABLE WIPER WITH SENSOR

(71) Applicants: David R. Hall, Provo, UT (US); Daniel Madsen, Vineyard, UT (US); Benjamin Taylor, Provo, UT (US); Lloyd J. Wilson, Herriman, UT (US)

(72) Inventors: David R. Hall, Provo, UT (US); Daniel Madsen, Vineyard, UT (US); Benjamin Taylor, Provo, UT (US); Lloyd J. Wilson, Herriman, UT (US)

(73) Assignee: Hall Labs LLC, Provo, UT (US)

( * ) Notice: Subject to any disclaimer, the term of this patent is extended or adjusted under 35 U.S.C. 154(b) by 327 days.

(21) Appl. No.: 15/294,019

(22) Filed: Oct. 14, 2016

(65) Prior Publication Data

US 2018/0105404 A1 Apr. 19, 2018

(51) Int. Cl.
*B66D 1/38* (2006.01)
*B66D 1/48* (2006.01)

(52) U.S. Cl.
CPC ..... *B66D 1/38* (2013.01); *B66D 1/485* (2013.01)

(58) Field of Classification Search
CPC .. B66D 1/38; B66D 1/36; B66D 1/485; B08B 1/02
See application file for complete search history.

(56) References Cited

U.S. PATENT DOCUMENTS

| | | | | | |
|---|---|---|---|---|---|
| 1,941,250 | A * | 12/1933 | Dale | B66D 1/36 | 242/157.1 |
| 2,495,039 | A * | 1/1950 | Tuel | B66D 1/36 | 242/476.7 |
| 2,660,382 | A * | 11/1953 | Wilson | B66D 1/36 | 242/157.1 |
| 4,422,208 | A * | 12/1983 | Rohrbaugh | D07B 7/12 | 15/236.09 |
| 4,468,006 | A * | 8/1984 | Frommherz | B66D 1/741 | 242/157 R |
| 5,386,882 | A * | 2/1995 | Friend | A46B 15/00 | 15/256.6 |
| 6,470,528 | B1 * | 10/2002 | Connolly | B66B 7/1284 | 15/256.6 |
| 6,811,112 | B1 * | 11/2004 | Currie | B65H 54/2872 | 242/157.1 |
| 8,141,260 | B2 * | 3/2012 | Pellen | G01B 11/26 | 33/366.24 |
| 9,399,566 | B2 * | 7/2016 | Hall | B66D 1/38 | |
| 9,586,237 | B2 * | 3/2017 | Calvet | B08B 1/002 | |
| 9,988,250 | B2 * | 6/2018 | Hall | B66D 1/28 | |
| 10,173,870 | B1 * | 1/2019 | Hall | B66D 1/39 | |
| 2007/0044267 | A1 * | 3/2007 | Connolly | B66B 7/1284 | 15/256.6 |
| 2011/0162573 | A1 * | 7/2011 | Race | H01Q 1/04 | 114/328 |

(Continued)

*Primary Examiner* — Michael E Gallion

(57) ABSTRACT

A winch is described comprising a compressional wiper system activated by a sensor that detects which direction a cable is moving. When the cable is being pulled in, the compressional wiper system tightens a clamp or fastens a rotatable clamping device inside a fairlead. The tightened clamp or fastened clamping device act to decrease the likelihood that dirt, mud, debris, or other materials that adhere to the cable accumulate within the winch, by wiping or scraping off said materials from the cable.

13 Claims, 15 Drawing Sheets

(56) References Cited

U.S. PATENT DOCUMENTS

| | | | | |
|---|---|---|---|---|
| 2012/0175576 | A1* | 7/2012 | Xydias | B66D 1/38 254/336 |
| 2013/0183133 | A1* | 7/2013 | Munk-Hansen | B66D 1/36 414/800 |
| 2013/0193256 | A1* | 8/2013 | Hawkes | B65H 75/4484 242/557 |
| 2014/0091268 | A1* | 4/2014 | Heravi | B66D 1/505 254/274 |
| 2014/0166953 | A1* | 6/2014 | Wright | B66D 1/56 254/270 |
| 2014/0291030 | A1* | 10/2014 | Urquhart | E21B 19/24 175/203 |
| 2018/0044151 | A1* | 2/2018 | Hall | B66D 1/38 |
| 2018/0093870 | A1* | 4/2018 | Hall | B66D 1/38 |
| 2018/0105403 | A1* | 4/2018 | Hall | B66D 1/00 |
| 2018/0105404 | A1* | 4/2018 | Hall | B66D 1/485 |
| 2018/0179032 | A1* | 6/2018 | Hall | B66D 1/38 |

* cited by examiner

DIRECTIONAL WINCH-CABLE WIPER WITH SENSOR

TECHNICAL FIELD

The present disclosure relates generally to the field of winches and hoists. More specifically, the present disclosure relates to an apparatus for cleaning a winch cable.

BACKGROUND

Winches are hauling or lifting devices, which pull in or let out a cable. The winch pulls in the cable by winding the cable around a horizontal rotating drum, or unwinding the cable from said drum. Winding the cable uniformly around the drum is optimal so that the cable does not bunch up around a single location on the drum and potentially jam the winch during winding. Dirt, mud, debris, and/or other materials can latch onto the cable when the cable is wound around the drum, causing an accumulation or buildup of said materials within the winch. Such buildup can disrupt uniform winding of the cable around the drum, and increase the likelihood of the winch jamming. Additionally, said materials may accumulate in other locations on the winch such as within a fairlead, cable guide, around a tensioner, in the gears, and/or other places where buildup may be unwanted. Thus, a need exists for an improvement to existing winches in order to reduce the amount of said materials that accumulate within the winch. Embodiments disclosed herein may improve performance of winches by reducing the ability for said materials to accumulate within the winch.

SUMMARY OF THE INVENTION

Disclosed herein is a winch, comprising a directional winch-cable wiper with sensor, which may reduce the likelihood that dirt, mud, debris, and/or other materials accumulate within the winch during winding. In one embodiment, a winch comprises a cable guide for positioning a cable during winding and unwinding. The cable guide includes a fairlead with a compressional wiper system. The compressional wiper system has a directional sensor to detect cable movement direction.

When the sensor detects that the cable is being reeled in as it is wound about the drum, an electrical signal is sent to a clamp or rotatable clamping device within the fairlead that has a plurality of jaws surrounding the cable. This electrical signal activates a clamping mechanism, which compresses the jaws, according to one embodiment, or in another embodiment, fastens the rotatable clamping device. Various embodiments may include jaws wherein a surface material of the jaws permits the cable to move when the jaws are compressed around the cable. The rotatable clamping device, according to one embodiment includes a surface material that permits the cable to move when the rotatable clamping device is fastened. In one embodiment, the compressional wiper system includes at least one electromagnetic element, and a rotating magnetic field that is used to spin the rotatable clamping device. During unwinding, the jaws are released, or rotatable clamping device is deactivated, permitting the cable to penetrate the fairlead without active wiping.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

In the following detailed description, numerous specific details are provided for a thorough understanding of the various embodiments disclosed herein. The embodiments disclosed herein can be manufactured without one or more of the specific details, or with other methods, components, materials, etc. In addition, in some cases, well-known structures, or characteristics may be combined in any suitable manner in one or more alternative embodiments.

Figure 1A:
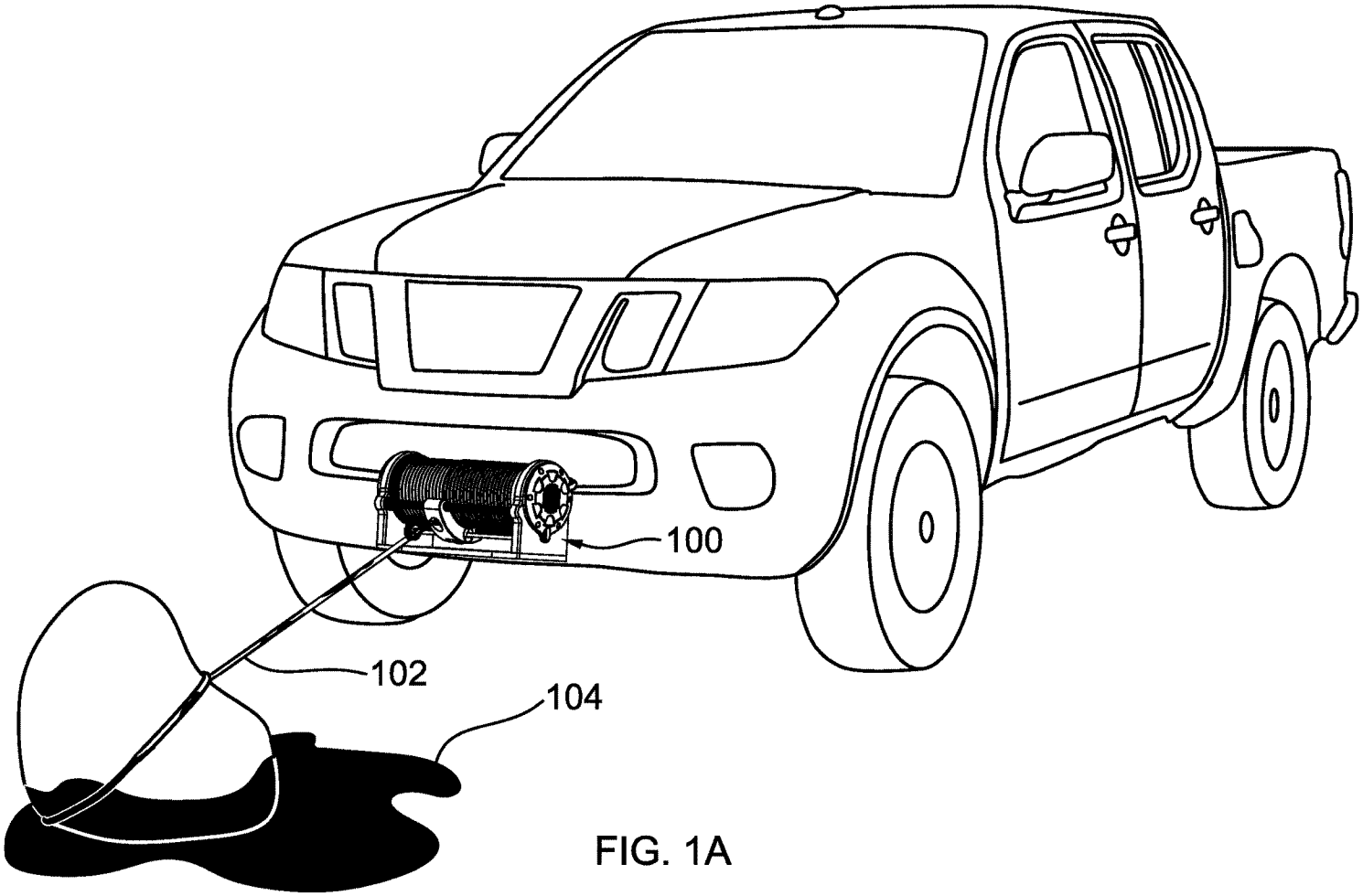
FIG. 1A depicts a winch, according to one embodiment, with a cable that is submerged in a muddy material.

FIG. 1A depicts a winch 100, according to one embodiment, with a cable 102 that is submerged in a muddy material 104. The muddy material 104 can stick to the cable 102 and accumulate within the winch 100. Optimally, the cable 102 will be uniformly distributed within the winch 100, but the muddy material 104, dirt, and/or other debris that accumulates in the winch 100 can disrupt the uniform distribution of the cable 102 when it is wound. Such disruptions in the cable 102 can cause the cable 102 to jam the winch 100 such that it is unable to pull in and/or let out the cable 102.

Figure 1B:
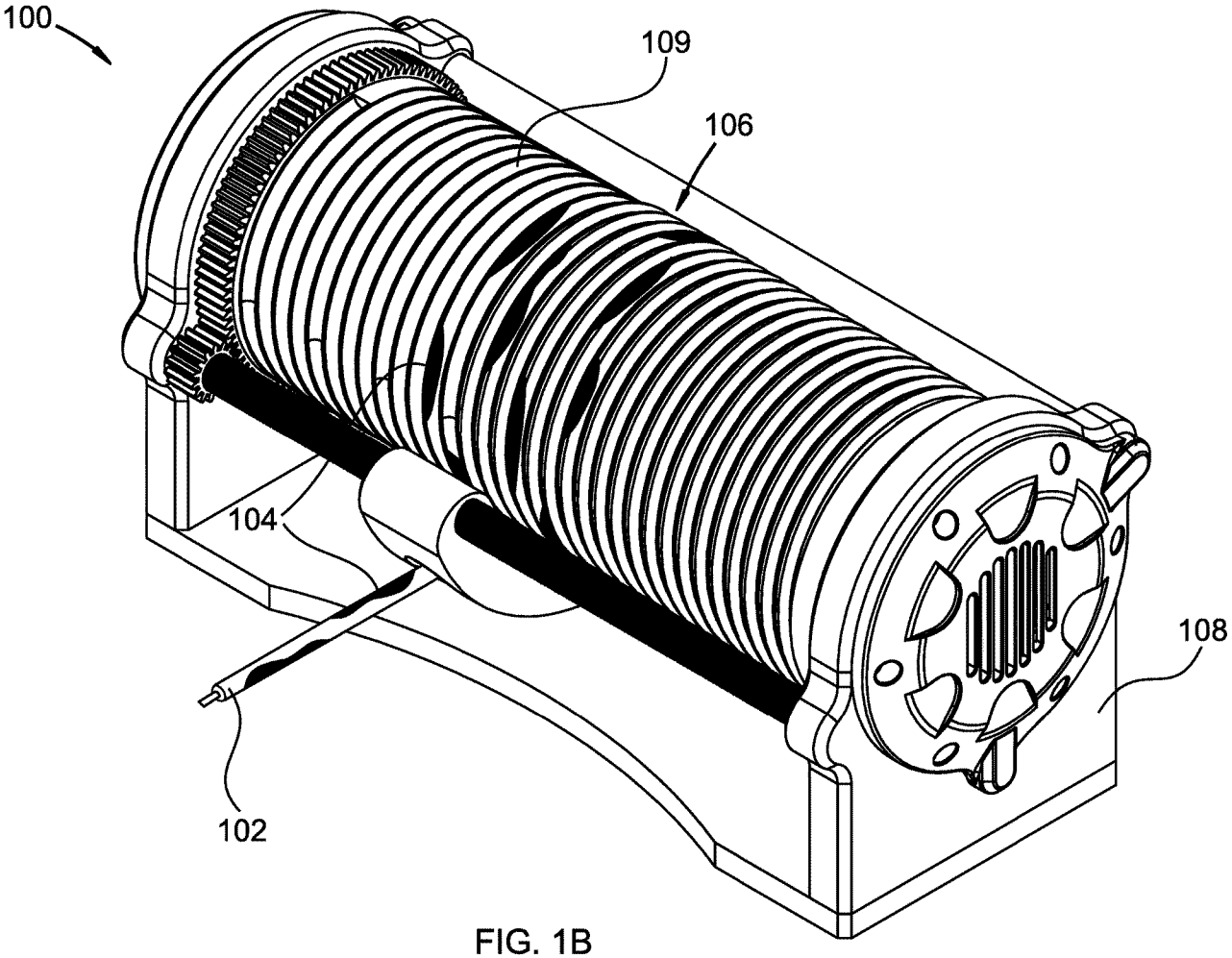
FIG. 1B is a close-up view of the winch of FIG. 1A, which shows muddy material on the cable and around a rotatable drum of the winch, according to one embodiment.

FIG. 1B is a close-up view of the winch 100 of FIG. 1A, which shows muddy material 104 on the cable 102 and around a rotatable drum 106 of the winch 100, according to one embodiment. The rotatable drum 106 is mounted within a frame 108 and supported for rotation about the drum's 106 longitudinal axis. The cable 102 is connected to the drum 106 such that when the cable 102 is wound around the drum 106 the cable 102 is pulled in, and when the cable 102 is unwound from the drum 106 the cable 102 is let out. The drum 106 in many embodiments is shaped as a right circular cylinder; however, the drum 106 can be of any variety shapes including an elliptic cylinder, a parabolic cylinder, a hyperbolic cylinder, an oblique cylinder, a cuboid, a rounded cuboid, a triangular prism, and/or any of a variety of other shapes. In some embodiments, the drum 106 includes a plurality of helical grooves 109 to assist in uniformly winding the cable 102 onto the drum 106.

The cable 102 may comprise any of a variety materials compatible with use on a winch 100, such as hemp, linen, flax, cellulose, carbon, wool, hair, feathers, cotton, coir, jute, straw, silk, sisal, polymers, nylon, Dyneema®, Kevlar®, rayon, orlon, polypropylene, polyesters, polyethylene, aramids, acrylics, copper, iron, steel, stainless steel, bronze, nichrome, carbon, solder, titanium, zinc, silver, gold, tungsten, aluminum, and/or other suitable material.

Figure 2:
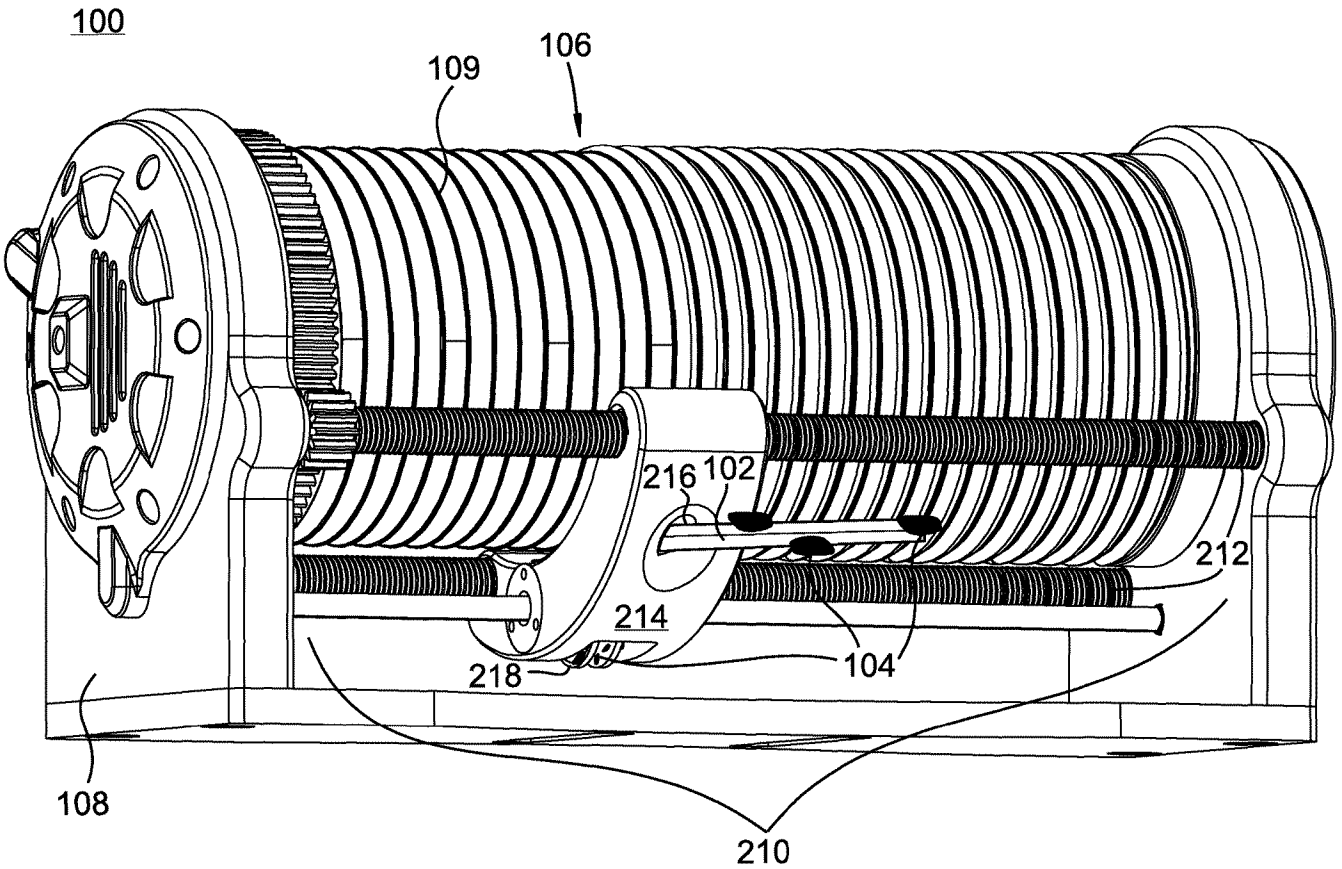
FIG. 2 is a perspective view of an embodiment of a winch with muddy material on the cable and stuck onto the tensioner.

FIG. 2 is a perspective view of an embodiment of a winch 100 with muddy material 104 on the cable 102 and stuck onto the tensioner 218. The winch 100 includes a guide 210 mounted on the frame 108 adjacent the drum 106 for positioning the cable 102 onto the drum 106. The guide 210 includes guide rods 212 disposed substantially parallel to the drum 106 axis, which support a fairlead 214 that is slidably attached to the guide rods 212. The fairlead 214 includes an orifice 216 through which the cable 102 passes during winding and unwinding. The tensioner 218, according to one embodiment, is a rotatable wheel positioned within the fairlead 214 such that the cable 102 passes along the tensioner 218 and is in frictional contact with the tensioner 218. The tensioner 218 rotates at a rotational speed that exceeds the rotational speed of the drum 106 as the cable 102 is let out from the drum 106, and passively rotates as the cable 102 is pulled in an wound onto the drum 106. A power source may be operatively connected to the guide 210 to slide the fairlead 214 along the guide rods 212 during winding and/or unwinding of the cable 102.

Figure 3A:
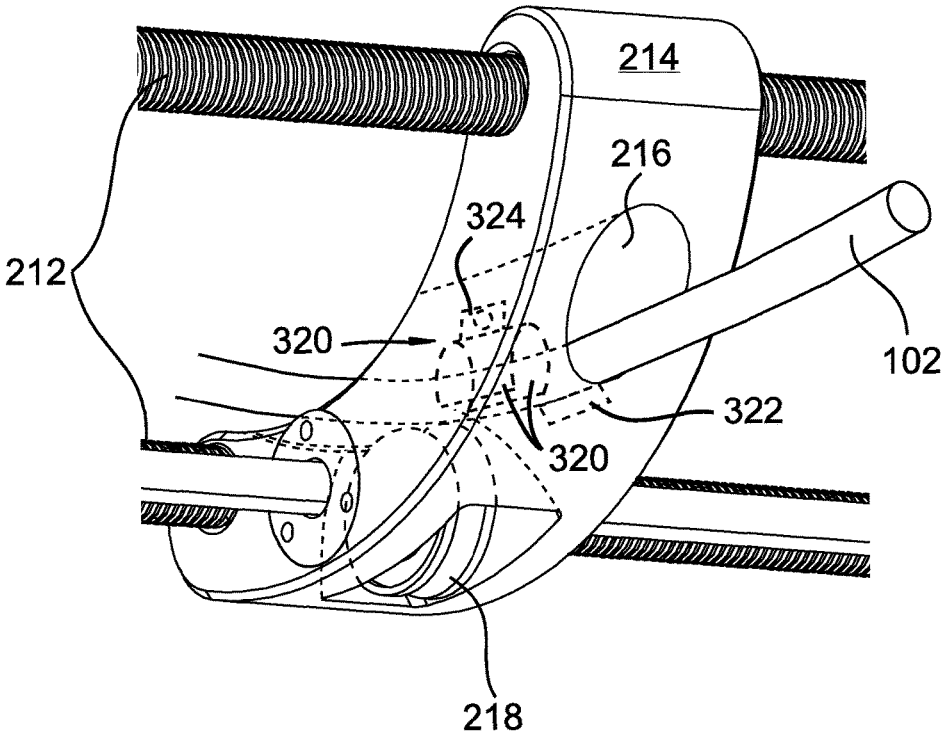
FIG. 3A illustrates a transparent view of a fairlead comprising a compressional wiper system, according to one embodiment.

FIG. 3A illustrates a transparent view of a fairlead 214 supported by guide rods 212, according to one embodiment. The fairlead 214 includes an orifice 216 through which the cable 102 passes during winding and unwinding. The cable 102 is in frictional contact with the tensioner 218 within the fairlead 214. The fairlead 214 also includes a compressional wiper system 320. The compressional wiper system 320 includes a directional sensor 322 that may detect which direction the cable 102 is moving. If the cable 102 is being pulled in during winding, then the sensor sends a signal to a clamp 324 to tighten its jaws 326 around the cable 102. When the cable 102 is not being pulled in, the clamp 324 is no longer activated, and the jaw 326 may be released and/or widened such that they are not in frictional contact with the cable 102 during unwinding. The jaws 326 may include a surface material that does not restrict movement of the cable 102. Thus, when the clamp 324 compresses the cable 102, dirt, mud, debris, or other materials that are adhered to the cable may be scraped and/or wiped off the cable 102. The tensioner 218 may be positioned more internal within the fairlead 214 than the clamp 324 such that dirt, mud, debris, or other materials are wiped of prior to the cable 102 coming into contact with the tensioner 218.

Figure 3B:
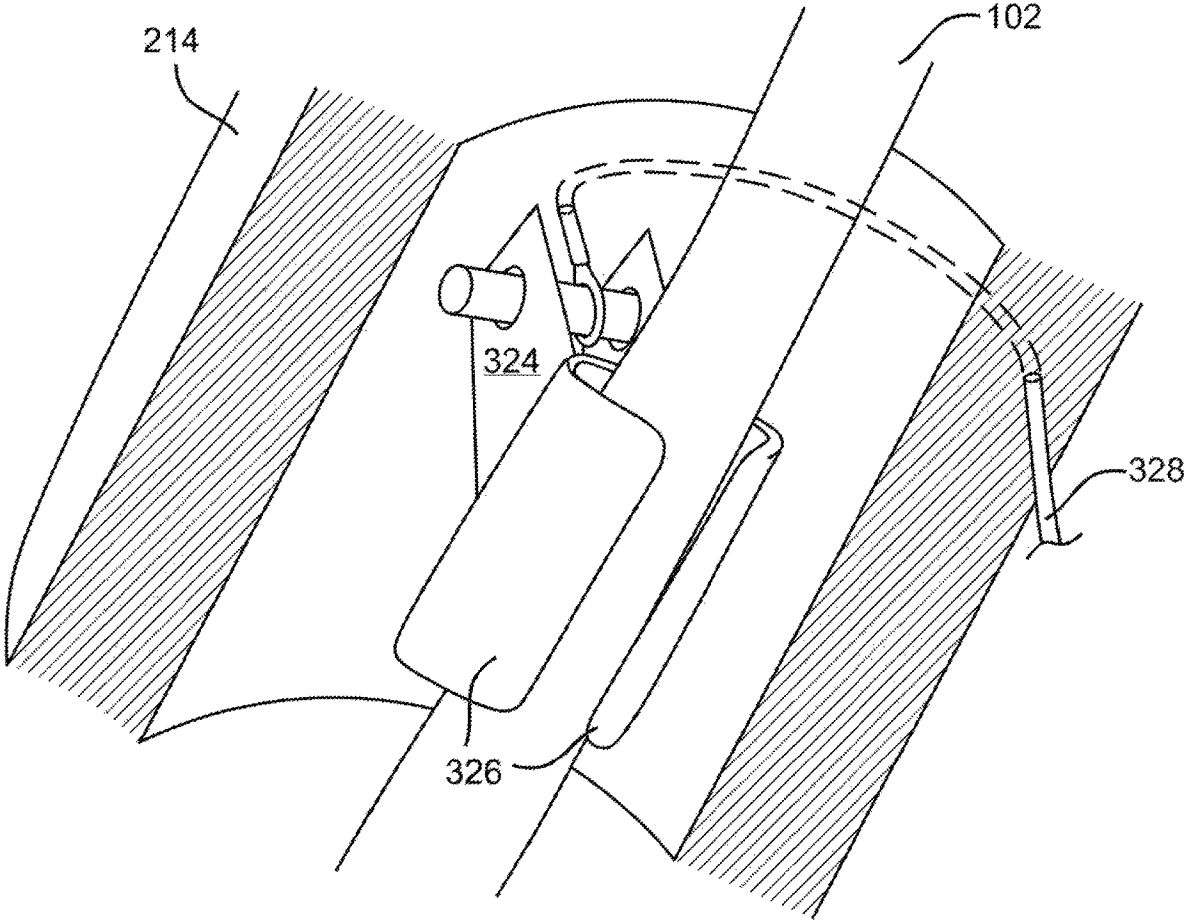
FIG. 3B is a cross-sectional view of the fairlead of FIG. 3A, according to one embodiment.

FIG. 3B is a cross-sectional view of the fairlead 214 of FIG. 3A, according to one embodiment. The clamp 324 may be operatively connected to an electrical wire 328 that passes through the fairlead 214. The electrical wire 328, according to one embodiment, may be the means by which a sensor (not shown) directs the clamp 324 to compress the jaws 326 around the cable 102.

Figure 3C:
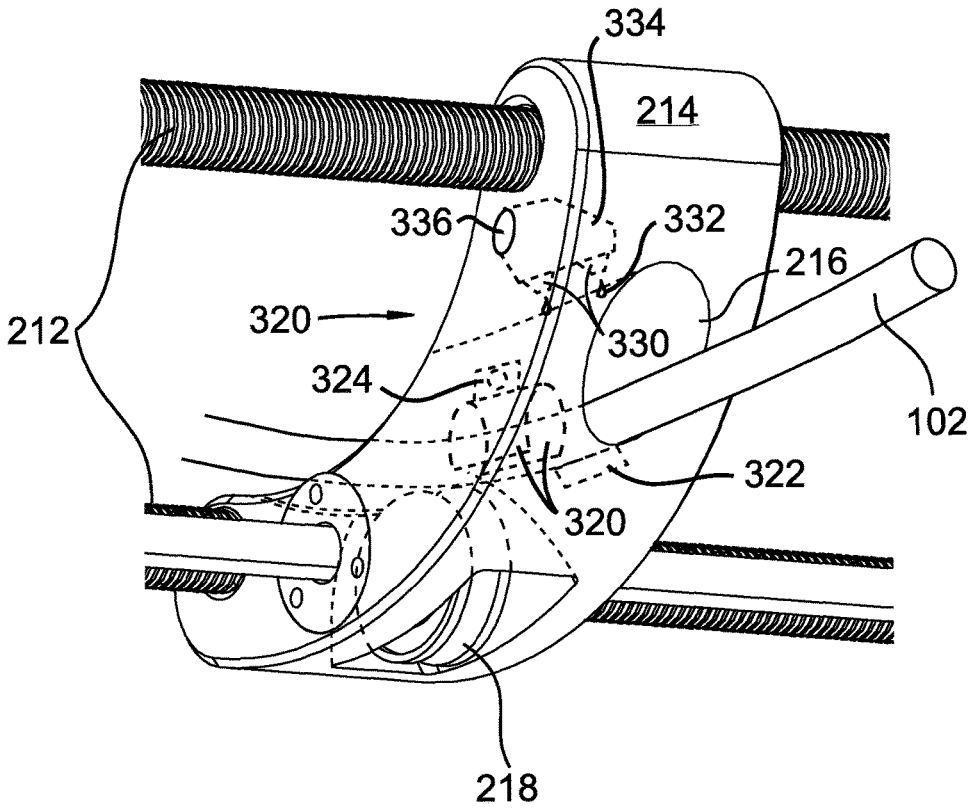
FIG. 3C depicts the fairlead from FIG. 3A further comprising nozzles for dispensing liquid onto a cable.

FIG. 3C depicts the fairlead 214 from FIG. 3A further comprising nozzles 330 for dispensing liquid 332 onto a cable 102. The nozzles 330 may be operatively connected to a chamber 334 for the liquid 332. The liquid 332 may include lubricants, grease, detergent, solvents, water, or combinations thereof. The compressional wiper system 320 may include an access-point 336 on the outer surface of the fairlead 214 for accessing the chamber 334.

Figure 3D:
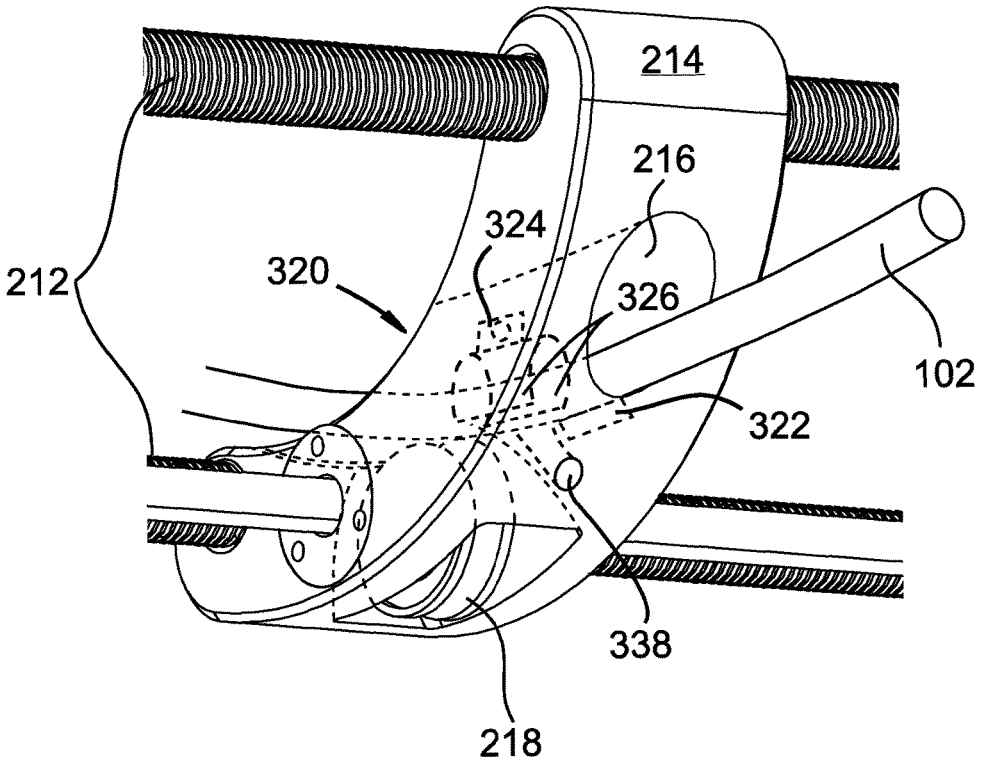
FIG. 3D illustrates the fairlead from FIG. 3A further comprising a disposal channel.

FIG. 3D illustrates the fairlead 214 from FIG. 3A further comprising a disposal channel 338. Various embodiments may include a plurality of disposal channels 338 extending from and/or near the surface of the jaws 326 that is in contact with the cable 102 to the outer surface of the fairlead 214. The disposal channels 338 allow for dirt, mud, debris, or other material that the jaws 326 wipe from the cable 102 to exit the orifice 216.

Figure 4:
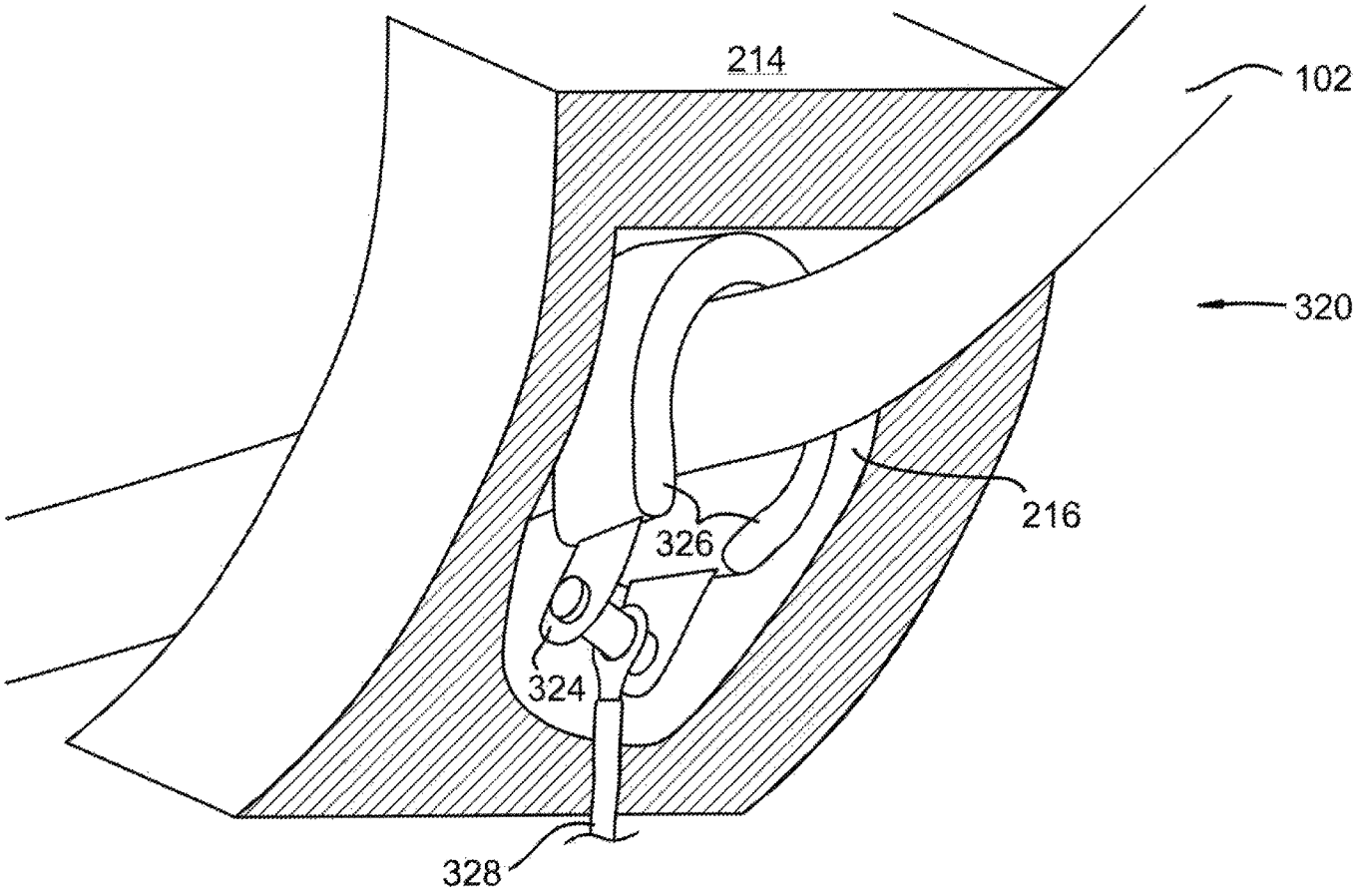
FIG. 4 illustrates a cross-sectional view of an orifice of a fairlead that includes a compressional wiper system, according to one embodiment.

FIG. 4 illustrates a cross-sectional view of an orifice 216 of a fairlead 214 that includes a compressional wiper system 320, according to one embodiment. The clamp 324 may compress the jaws 326 in response to an activation signal sent via an electrical wire 328. According to one embodiment, the clamp 324 may include piezoelectric material. The cable 102 may still be pulled in when the jaws 326 are compressed, but dirt, mud, debris, or other materials will be wiped and/or slough off the cable 102 when they come in contact with the jaws 326.

Figure 5:
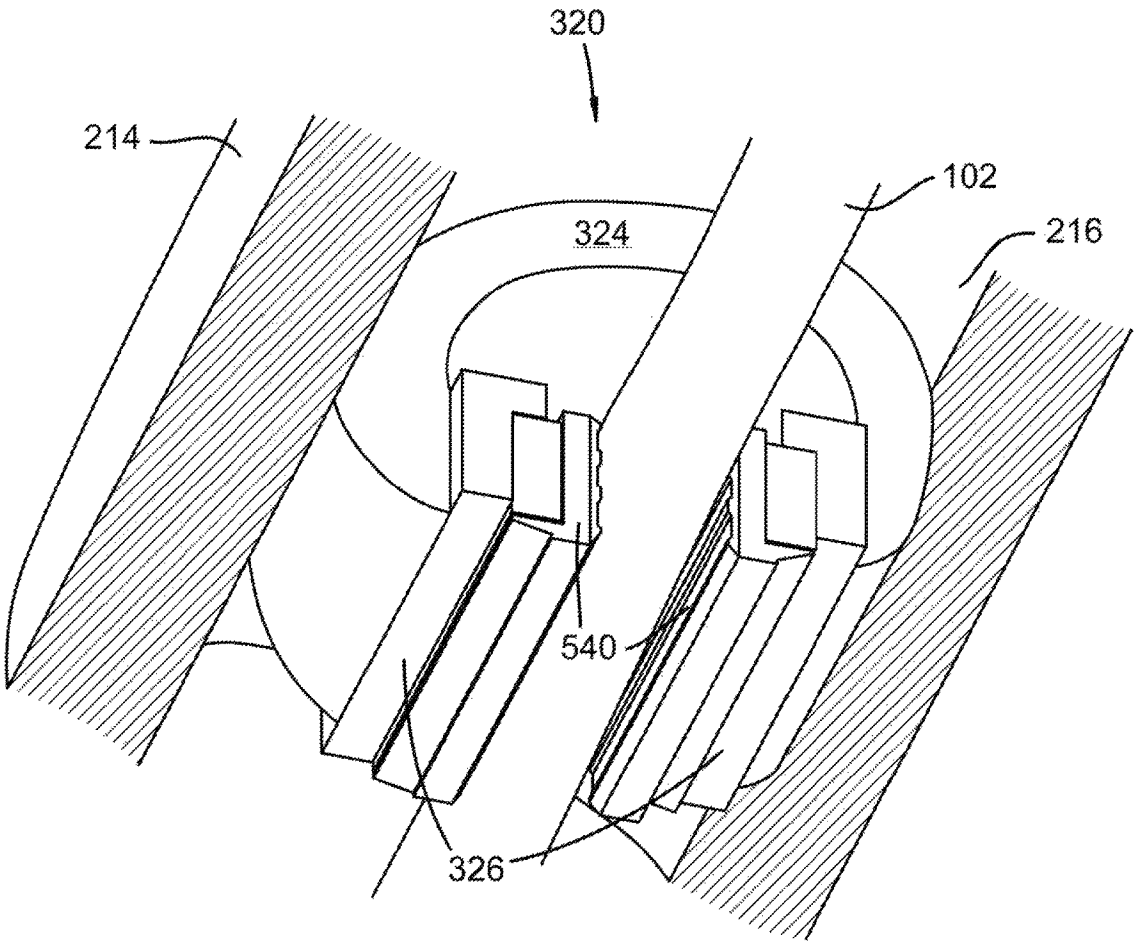
FIG. 5 depicts a cross-sectional view of an orifice of a fairlead comprising an embodiment of a compressional wiper system.

FIG. 5 depicts a cross-sectional view of an orifice 216 of a fairlead 214 comprising an embodiment of a compressional wiper system 320. The jaws 326 may include a jaw surface 540 comprised of at least one surface discontinuity such that there are multiple compression points between the jaws 326 and the cable 102. According to various embodiments, the jaw surface 540 may be comprised of rubber, plastic, polypropylene, polyvinyl chloride, acrylonitrile butadiene styrene, polyurethane, latex, or other similar materials.

Figure 6:
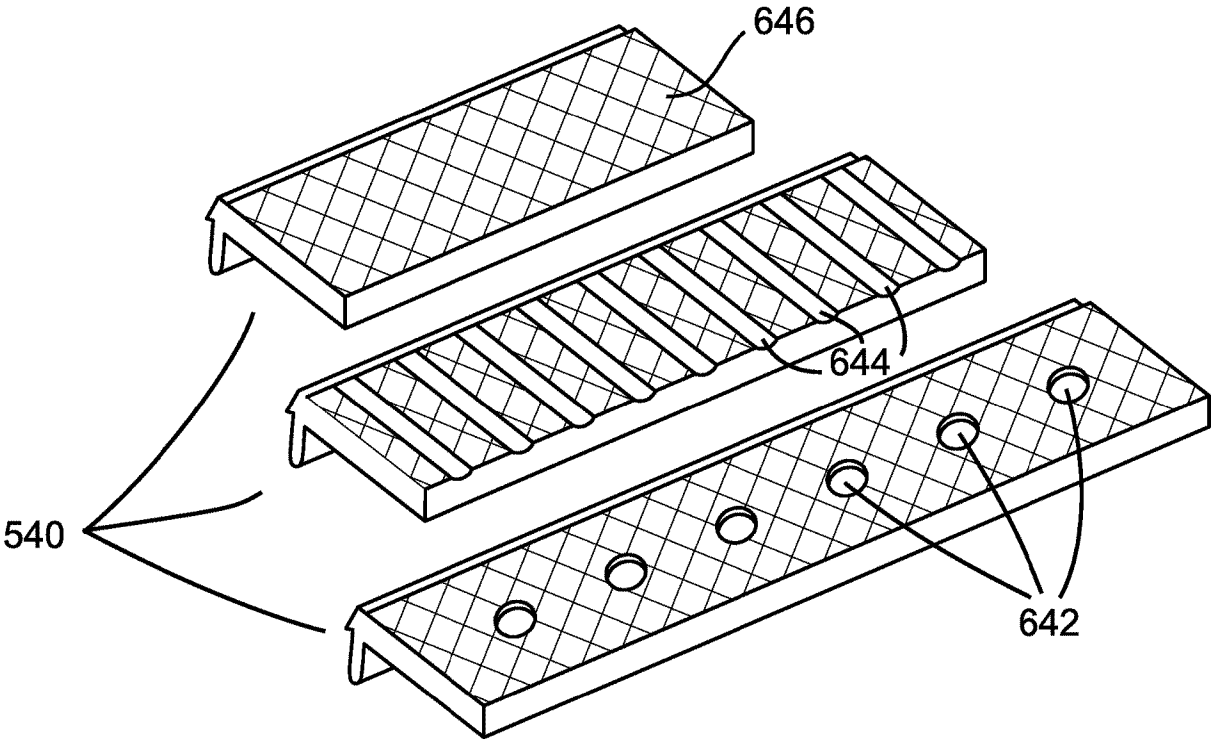
FIG. 6 depicts several embodiments of jaw surfaces for a clamp.

FIG. 6 depicts several embodiments of jaw surfaces 540 for a clamp (not shown). The jaw surfaces 540 may be porous, and include one or more apertures 642 through which dirt, mud, debris, or other materials may permeate during wiping, according to one embodiment. In another embodiment, the jaw surfaces 540 may include one or more depressions 644. Alternatively, the jaw surface 540 may be relatively smooth 646, according to one embodiment.

Figure 7:
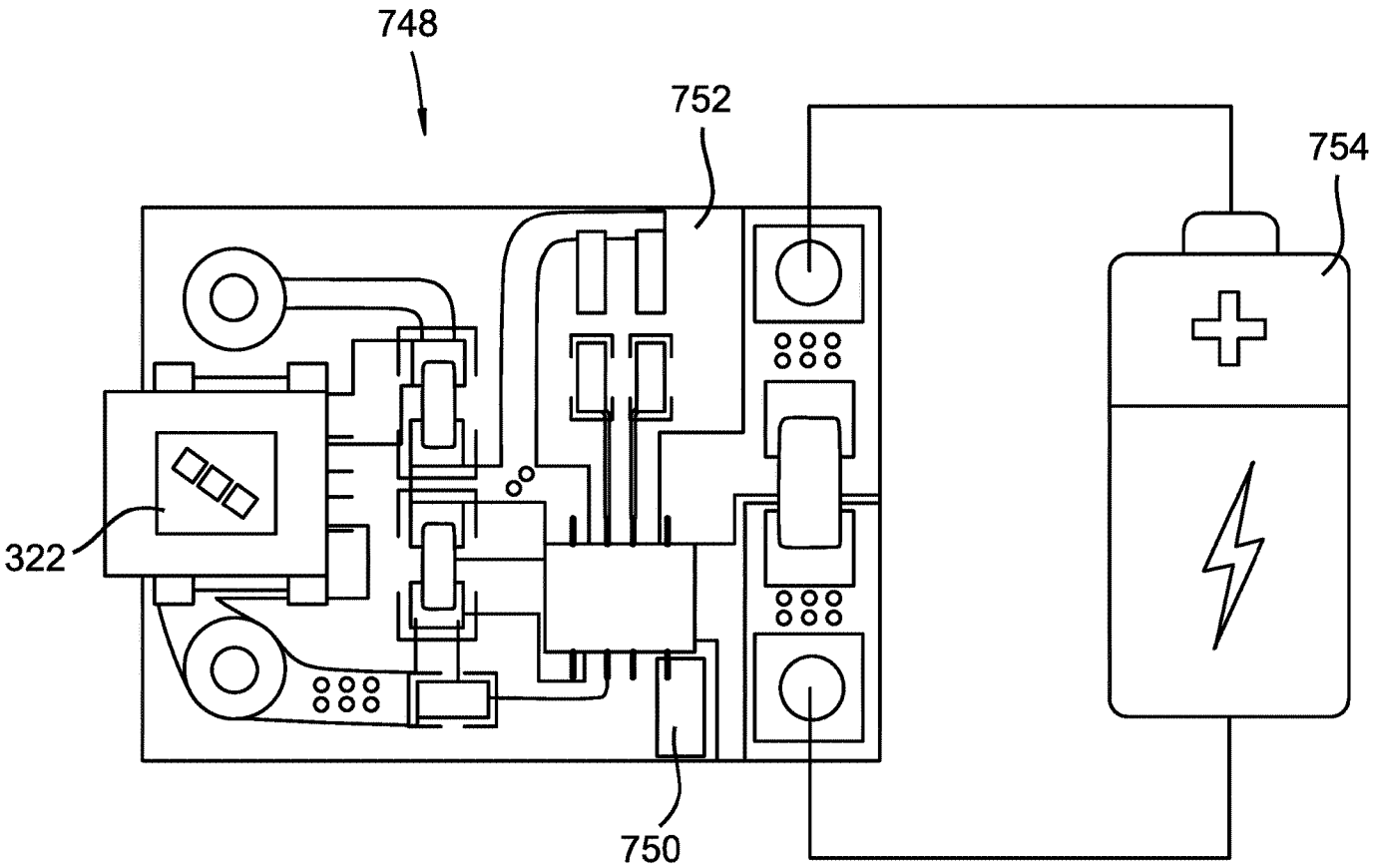
FIG. 7 illustrates a circuit board comprising a sensor, integrated circuits, other electrical components, and a battery.

FIG. 7 illustrates an electrical circuit board 748 comprising a sensor 322, integrated circuits 750, other electrical components 752, and a battery 754. The sensor 322, according to various embodiments, may be an active infrared sensor, passive infrared sensor, microwave motion sensor, ultrasonic motion sensor, a piezoelectric sensor, or other sensor suitable to detect which direction the cable is moving based on any number of measurable properties such as changes in pressure, displacement, etc. The battery 754 may include one or more rechargeable or self-charging electrochemical cells.

The circuit board 748 may be used to mechanically support and electrically connect electronic components using conductive tracks, according to one embodiment.

Several electric components 752 such as capacitors, resistors, etc. may be soldered onto the circuit board 748. The circuit board 748 may be located within the fairlead (not shown) and at least partially protected from outside elements. According to one embodiment, the circuit board 748 electrically connects the battery 754 to the sensor 322. The circuit board 748 may also be electrically connected to one or more electric wires (see FIGS. 3B and 4, 338) that send an electric signal to the clamps (see FIGS. 3A-5, 324) to compress during winding.

Figure 8:
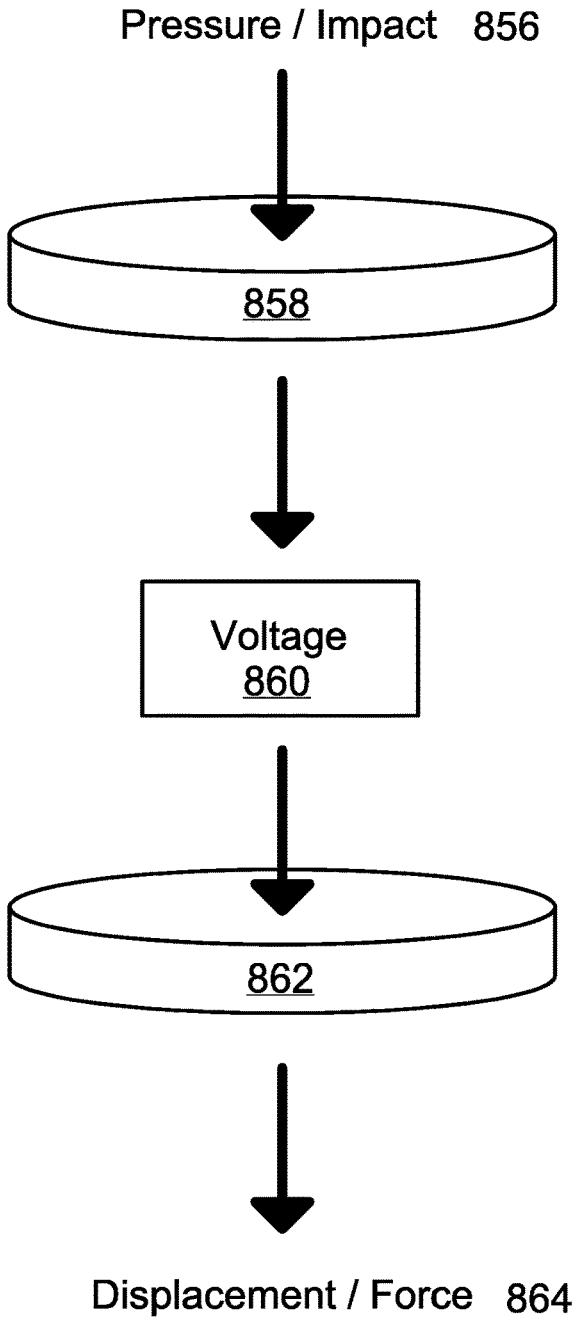
FIG. 8 is a chart depicting how a pressure that is applied to a piezoelectric material generates a voltage, which is sent to a second piezoelectric material that causes displacement of a clamp.

FIG. 8 is a chart depicting how a pressure 856 that is applied to a piezoelectric material 858 generates a voltage 860, which is sent to a second piezoelectric material 862 that causes displacement 864 of a clamp (see FIGS. 3A-5, 324). The pressure 856 may be applied when pulling in a load attached to a cable, according to one embodiment. The pressure 856 may be applied to an embodiment of a sensor comprised of piezoelectric material 858, which generates a voltage 860. The voltage 860 may be conveyed via an electrical wire to a second piezoelectric material 862, which generates displacement 864 of a clamp, according to one embodiment.

Figure 9A:
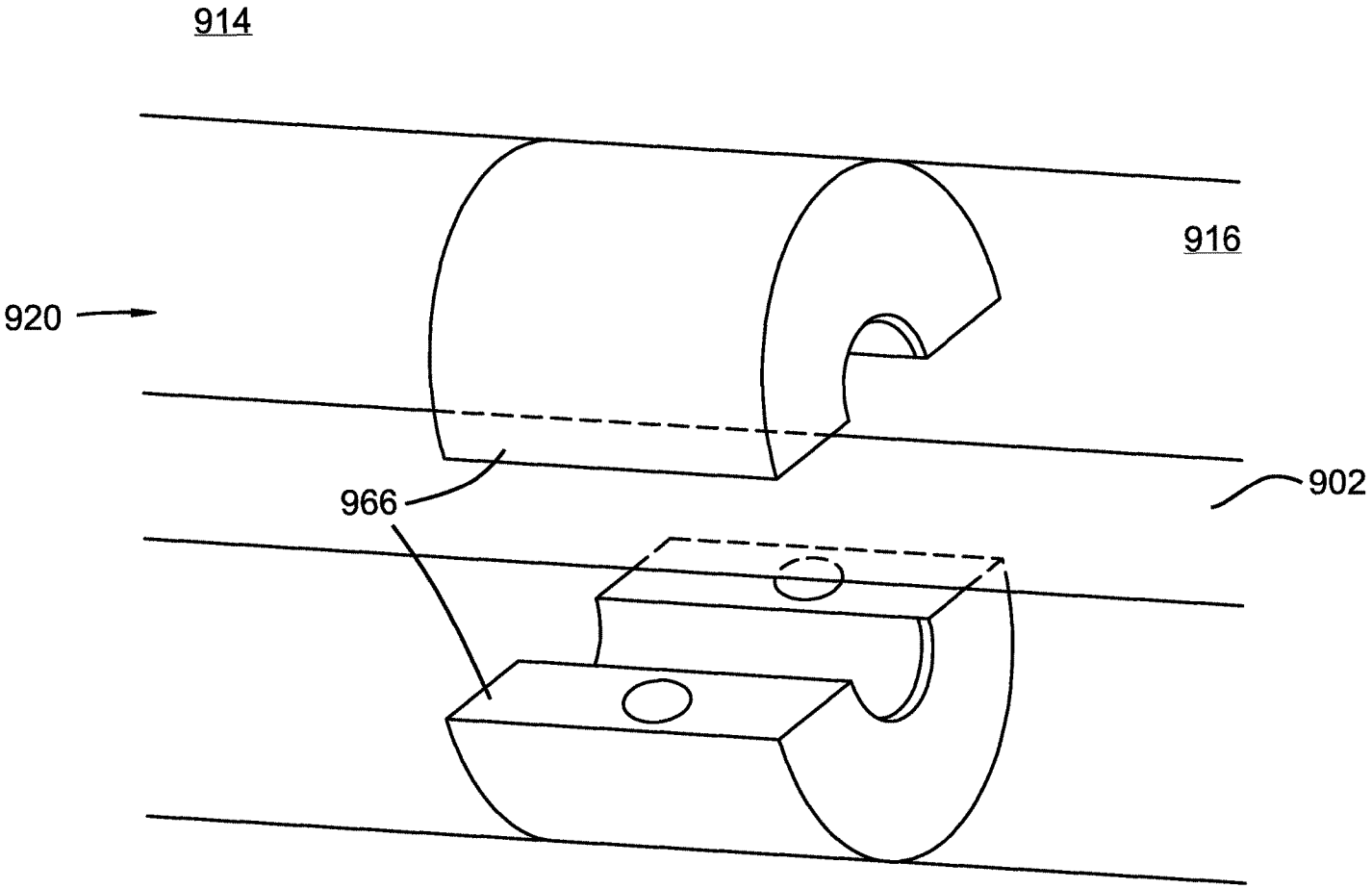
FIG. 9A is a cross-sectional view of an orifice for a fairlead with an embodiment of a compressional wiper system comprising a rotatable clamping device.

FIG. 9A is a cross-sectional view of an orifice 916 for a fairlead 914 with an embodiment of a compressional wiper system 920 comprising a rotatable clamping device 966. The rotatable clamping device 966 may be operatively connected to the sensor and includes a surface material that permits the cable 902 to move when the rotatable clamping device 966 is fastened around the cable 902. The compressional wiper system 920, according to one embodiment, may include an electrical circuit board coupled to the sensor, a battery, and comprising one or more integrated circuits and/or other electrical components. The battery may include one or more rechargeable and/or self-charging electrochemical cells.

Figure 9B:
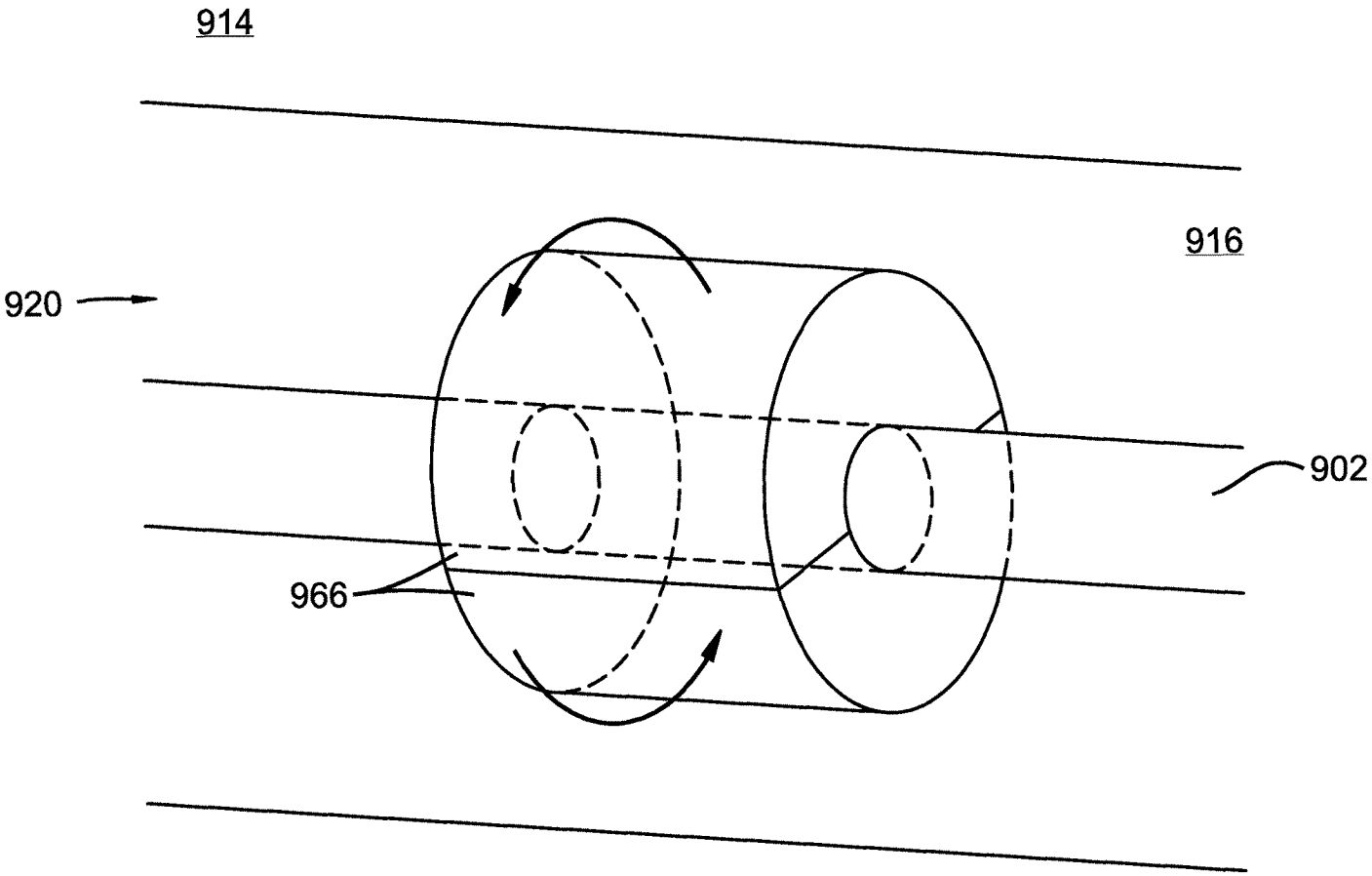
FIG. 9B is a cross-sectional view of the orifice of FIG. 9A wherein the rotatable clamping device is fastened around a cable.

FIG. 9B is a cross-sectional view of the orifice 916 of FIG. 9A wherein the rotatable clamping device 966 is fastened around a cable 902. The rotatable clamping device 966 may comprise at least one switchable magnet that is activated during winding of the cable 902 to fasten the rotatable clamping device 966 around the cable 902.

Figure 10A:
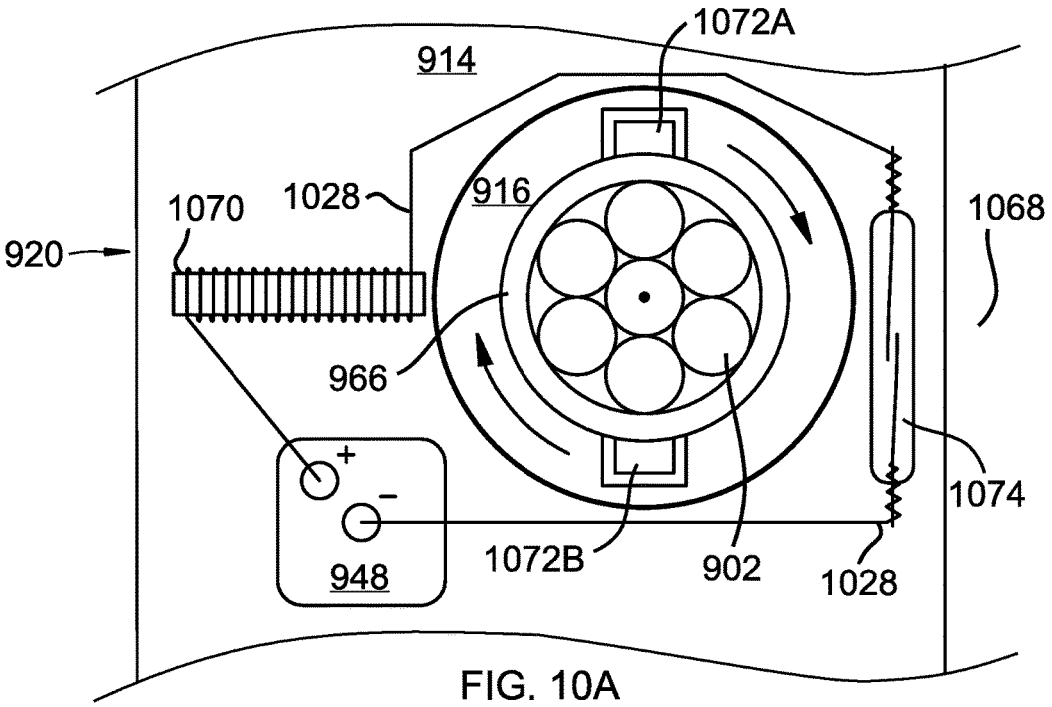
FIG. 10A depicts a reed switch motor that spins the rotatable clamping device, according to one embodiment, around the cable.

FIG. 10A depicts a reed switch motor 1068 that spins the rotatable clamping device 966, according to one embodiment, around the cable 902. The fairlead 914 may include a compressional wiper system 920 comprising an electrical circuit board 948 electrically coupled to a battery and a sensor. The electrical circuit board 948 may also include integrated circuits and/or other electrical components. The sensor may send an electrical signal via an electrical wire 1028 when the cable 902 is being pulled in. The electrical signal may displace an electromagnetic element 1070 that then interacts with one or more magnets 1072A and 1072B, which are connected to the rotatable clamping device 966. The electromagnetic element 1070 may repel a magnet 1072A, which turns toward a reed switch 1074 closing the switch and sending an electric signal via and electrical wire 1028 to the electrical circuit board 948. An electrical signal is again sent to the electromagnetic element 1070, which then repels another magnet 1072B, which repeats the aforementioned process causing the rotatable clamping device 966 to spin around the cable 902.

Figure 10B:
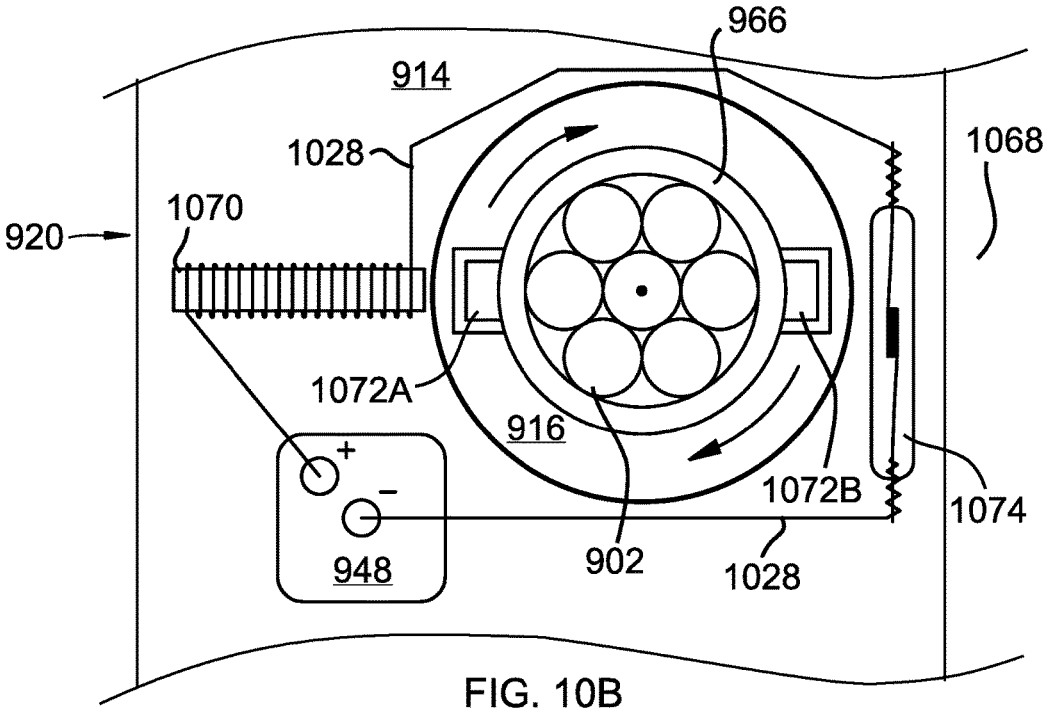
FIG. 10B illustrates rotation of the rotatable clamping device of FIG. 10A.

FIG. 10B illustrates rotation of the rotatable clamping device 966 of FIG. 10A. The magnets 1072A and 1072B have shifted due to a rotating magnetic field that spins the rotatable clamping device 966 within the orifice 916. According to various embodiments, the fairlead 914 may include one or more disposal channels, wherein said channels extend from an initial point of contact between the cable and the first and/or second rotatable press to an outer surface of the fairlead. Various embodiments of the compressional wiper system 920 may include one or more nozzles for dispensing at least one liquid onto the cable, and which are operatively connected to a chamber for storing one or more liquids.

The invention claimed is:

1. A winch, comprising:

a cable guide for positioning a cable during winding and unwinding;

the cable guide comprising a fairlead;

the fairlead comprising a compressional wiper system;

the compressional wiper system comprising:

a directional sensor to detect cable movement direction;

a clamp comprising a plurality of jaws;

the jaws surrounding the cable;

wherein the sensor sends an electrical signal to the clamp to tighten the jaws around the cable during winding and to widen the jaws when the cable is not being pulled in; and wherein the jaws comprise a surface material that permits the cable to move when the jaws are compressed around the cable.

2. The winch of claim 1, wherein the compressional wiper system comprises one or more nozzles for dispensing at least one liquid onto the cable, and which are operatively connected to a chamber for storing one or more liquids.

3. The winch of claim 2, wherein the one or more liquids are comprised of lubricants, grease, detergent, solvents, water, or combinations thereof.

4. The winch of claim 2, wherein the compressional wiper system comprises an access-point on an outer surface of the fairlead for accessing the chamber.

5. The winch of claim 1, wherein the sensor comprises a sensing element of piezoelectric material and/or a clamping element of piezoelectric material.

6. The winch of claim 5, wherein the sensor is operatively connected to a battery comprising one or more rechargeable or self-charging electrochemical cells.

7. The winch of claim 1, wherein the sensor is operatively connected to a circuit board comprising one or more integrated circuits and/or other electrical components.

8. The winch of claim 1, further comprising a power source operatively connected to the cable guide to move the fairlead during winding and/or unwinding of the cable.

9. The winch of claim 1, wherein the fairlead comprises one or more disposal channels extending from and/or near the surface of the jaws that is in contact with the cable to the outer surface of the fairlead.

10. The winch of claim 1, wherein the fairlead comprises a tensioner positioned more internal within the fairlead than the one or more clamps.

11. The winch of claim 1, wherein the surface of the jaws is comprised of at least one surface discontinuity such that there are multiple compression points between the jaws and the cable.

12. The winch of claim 1, wherein the surface of the jaws is porous.

13. The winch of claim 1, wherein the surface of the jaws is comprised of rubber, plastic, polypropylene, polyvinyl chloride, acrylonitrile butadiene styrene, polyurethane, latex, or other similar materials.

* * * * *